US006554516B1

(12) United States Patent
Christopher

(10) Patent No.: US 6,554,516 B1
(45) Date of Patent: Apr. 29, 2003

(54) WRITING INSTRUMENT WITH RETRACTABLE INK CARTRIDGE AND RETRACTABLE CORRECTING FLUID CARTRIDGE

(76) Inventor: Fania Christopher, 1900 S. Locust St., Denver, CO (US) 80224

( * ) Notice: Subject to any disclaimer, the term of this patent is extended or adjusted under 35 U.S.C. 154(b) by 0 days.

(21) Appl. No.: 10/080,632

(22) Filed: Feb. 22, 2002

(51) Int. Cl.[7] ..... B43K 27/00
(52) U.S. Cl. ..... 401/31; 401/29
(58) Field of Search ..... 401/29, 30, 31, 401/32, 33, 195, 107

(56) References Cited

U.S. PATENT DOCUMENTS 3,079,894 A * 3/1963 Johmann ..... 401/31
3,288,116 A * 11/1966 Poritz ..... 401/30
3,594,091 A * 7/1971 Bleuer ..... 401/107
3,733,139 A 5/1973 Neidhardt et al.
3,941,488 A 3/1976 Maxwell
4,000,950 A * 1/1977 Wahlberg ..... 401/32
4,227,930 A 10/1980 Lin
4,266,881 A * 5/1981 Rubens ..... 401/32
4,600,327 A 7/1986 Guzman
4,979,840 A 12/1990 Madaus et al.
D321,717 S 11/1991 Hager
5,584,592 A * 12/1996 Craig ..... 401/31

* cited by examiner

*Primary Examiner*—David J. Walczak

(57) ABSTRACT

A writing instrument with a retractable ink cartridge and retractable correcting fluid cartridge mounted on opposite ends. Actuators on the barrel of the writing instrument would extend or retract the writing or correcting tool desired. The correcting fluid end incorporates a sealed aperture to keep the correction fluid from drying out. This combination of tools and ease of use makes for a more versatile and convenient tool for writing, correcting or editing documents.

14 Claims, 4 Drawing Sheets

WRITING INSTRUMENT WITH RETRACTABLE INK CARTRIDGE AND RETRACTABLE CORRECTING FLUID CARTRIDGE

BACKGROUND OF THE INVENTION

1. Field of the Invention

The present invention relates to combination writing/correcting instruments and more particularly pertains to a new writing instrument with retractable ink cartridges and retractable correcting fluid cartridge for purpose.

2. Description of the Prior Art

The use of combination writing/correcting instruments is known in the prior art. More specifically, combination writing/correcting instruments heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes; U.S. Pat. No. 3,733,139 teaches a pen with a single retractable ink cartridge at one end and at the opposite end a correcting fluid applicator. The correcting fluid applicator is sealed with a cap designed to fit on either end of the writing instrument. The applicator is statically mounted.

U.S. Pat. No. 3,941,488 teaches a marker and a correction fluid applicator that can both be mounted to a central barrel. Neither the scribing device nor the correction fluid applicator includes a mechanism for protraction/retraction.

U.S. Pat. No. 4,227,930 teaches a scribing device with a first end that applies ink and a second end that applies correcting fluid. The two ends can be removed from each other and a cap is used to seal the end that is not in use. Neither the scribing end nor the correction fluid applicator end includes a mechanism for protraction/retraction.

U.S. Pat. No. 4,600,327 teaches a writing instrument that has an ink applicator at the first end and a hollow cylindrical reservoir for correcting fluid at the second end. The reservoir is sealed with a cap that includes an applicator brush for applying correction fluid.

U.S. Pat. No. 4,979,840 teaches a cartridge style fountain pen with a reserve compartment at the end opposite the scribing end. The reserve end may store additional ink cartridges or an applicator for applying correction fluid. The pen also includes a mechanism to visually denote whether or not the liquid applicator is in place.

U.S. Design Patent No. Des. 321,717 teaches the ornamental design of a combination writing/correcting instrument similar to that described in U.S. Pat. No. 4,600,327.

While these devices fulfill their respective, particular objectives and requirements, the aforementioned patents do not disclose a new writing instrument with retractable ink cartridge and retractable correcting fluid cartridge. The inventive device includes a plurality of protractible/retractable ink cartridge available from an orifice on the first side and a protractible/retractably sealed correction fluid applicator on a second end.

In these respects, the writing instrument with retractable ink cartridge and retractable correcting fluid cartridge according to the present invention substantially departs from the conventional concepts and designs of the prior art, and in so doing provides an apparatus primarily developed for the purpose of a more versatile and convenient tool for writing.

SUMMARY OF THE INVENTION

In view of the foregoing disadvantages inherent in the known types of combination writing/correcting instruments now present in the prior art, the present invention provides a new writing instrument with retractable ink cartridge and retractable correcting fluid cartridge construction wherein the same can be utilized for increased versatility and convenience for all aspects of writing.

The general purpose of the present invention, which will be described subsequently in greater detail, is to provide a new writing instrument with retractable ink cartridge and retractable correcting fluid cartridge apparatus and method which has many of the advantages of the combination writing/correcting instruments mentioned heretofore and many novel features that result in a new writing instrument with retractable ink cartridge and retractable correcting fluid cartridge which is not anticipated, rendered obvious, suggested, or even implied by any of the prior art combination writing/correcting instruments, either alone or in any combination thereof.

To attain this, the present invention generally comprises a writing instrument with a plurality of ink cartridge contained within the barrel of the writing instrument. The cartridges ink applicators protractibly/retractably available from a single orifice on the first end of the writing instrument. The applicators would protract/retract upon the actuation of an external control. The writing instrument would also include a protractible/retractable correction fluid cartridge including a correction fluid reservoir and applicator that would also protract/retract from a second orifice located on the second end of the writing instrument. This second orifice would be self-sealing to preserve the fluidity of the correction fluid.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new writing instrument with retractable ink cartridge and retractable correcting fluid cartridge apparatus and method which has many of the advantages of the combination writing/correcting instruments mentioned heretofore and many novel features that result in a new writing instrument with retractable ink cartridge and retractable correcting fluid cartridge which is not anticipated, rendered obvious, suggested, or even implied by any of the prior art combination writing/correcting instruments, either alone or in any combination thereof.

It is another object of the present invention to provide a new writing instrument with retractable ink cartridge and retractable correcting fluid cartridge, which may be easily and efficiently manufactured and marketed.

It is a further object of the present invention to provide a new writing instrument with retractable ink cartridge and retractable correcting fluid cartridge, which is of a durable and reliable construction.

An even further object of the present invention is to provide a new writing instrument with retractable ink cartridge and retractable correcting fluid cartridge which is susceptible of a low cost of manufacture with regard to both materials and labor, and which accordingly is then susceptible of low prices of sale to the consuming public, thereby making such writing instrument with retractable ink cartridge and retractable correcting fluid cartridge economically available to the buying public.

Still yet another object of the present invention is to provide a new writing instrument with retractable ink cartridge and retractable correcting fluid cartridge which provides in the apparatuses and methods of the prior art some of the advantages of the availability of correction fluid applicator in the same tools as the ink applicator, while simultaneously overcoming some of the disadvantages such as the use of a cap or separate brush applicator.

Still another object of the present invention is to provide a new writing instrument with retractable ink cartridge and retractable correcting fluid cartridge for a more versatile and convenient tool for writing in that it would provide a variety of ink applicators in conjunction with a correcting fluid applicator.

Yet another object of the present invention is to provide a writing instrument with a plurality of ink cartridge contained within the barrel of the writing instrument. The cartridge's ink applicators protractibly/retractably available from a single orifice on the first end of the writing instrument. The applicators would protract/retract upon the actuation of an external control. The writing instrument would also include a protractible/retractable correction fluid cartridge including a correction fluid reservoir and applicator that would also protract/retract from a second orifice located on the second end of the writing instrument. This second orifice would be self-sealing to preserve the fluidity of the correction fluid.

Still yet another object of the present invention is to provide a new writing instrument with retractable ink cartridge and retractable correcting fluid cartridge wherein the method to select an ink applicator or the correction fluid applicator is determined by simple external controls.

Even still another object of the present invention is to provide a new writing instrument with retractable ink cartridge and retractable correcting fluid cartridge that does not require one or more caps to protect the incorporated applicators.

These together with other objects of the invention, along with the various features of novelty, which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
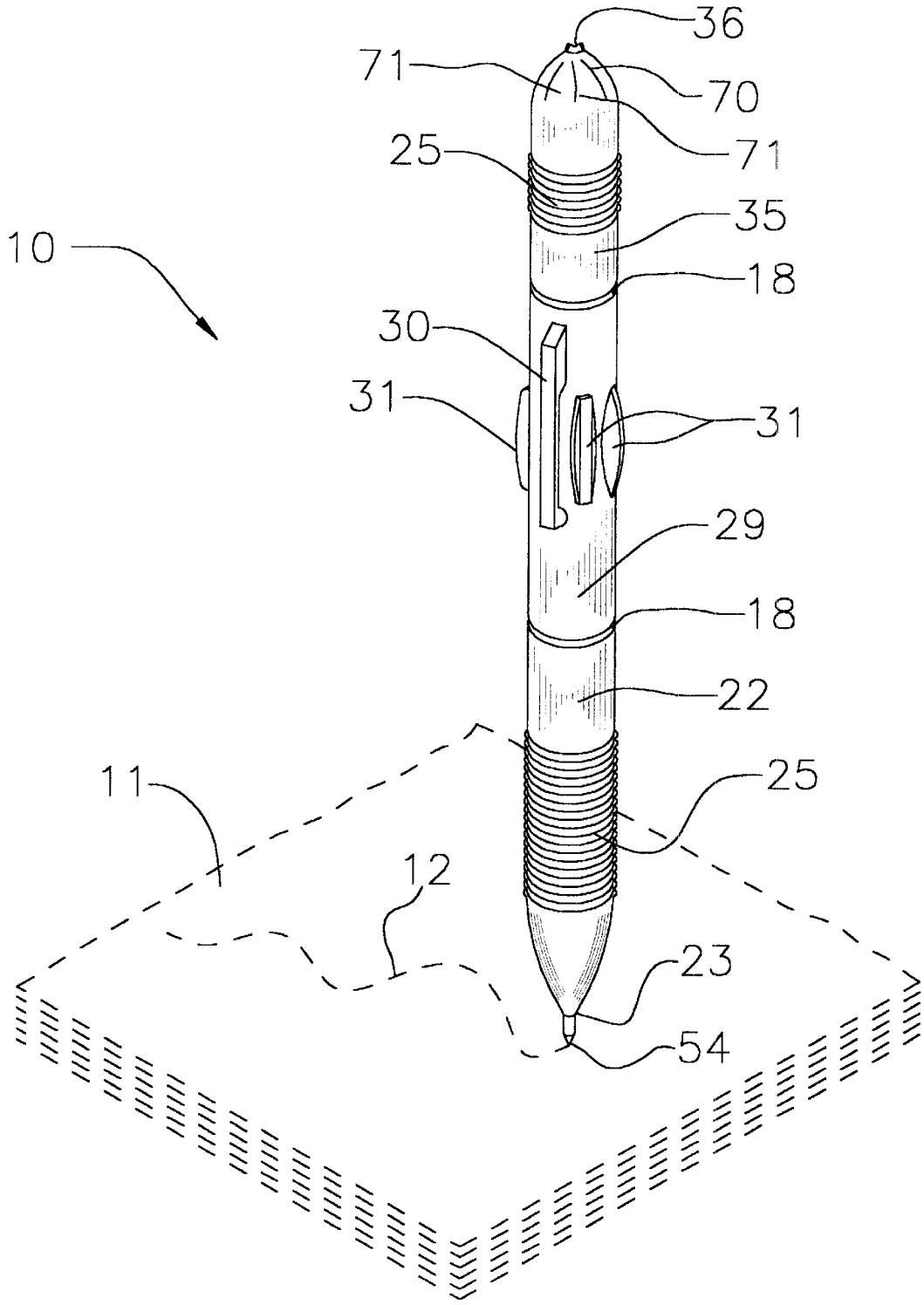
FIG. 1 is a perspective view of a new writing instrument with retractable ink cartridge and retractable correcting fluid cartridge according to the present invention.
Figure 2:
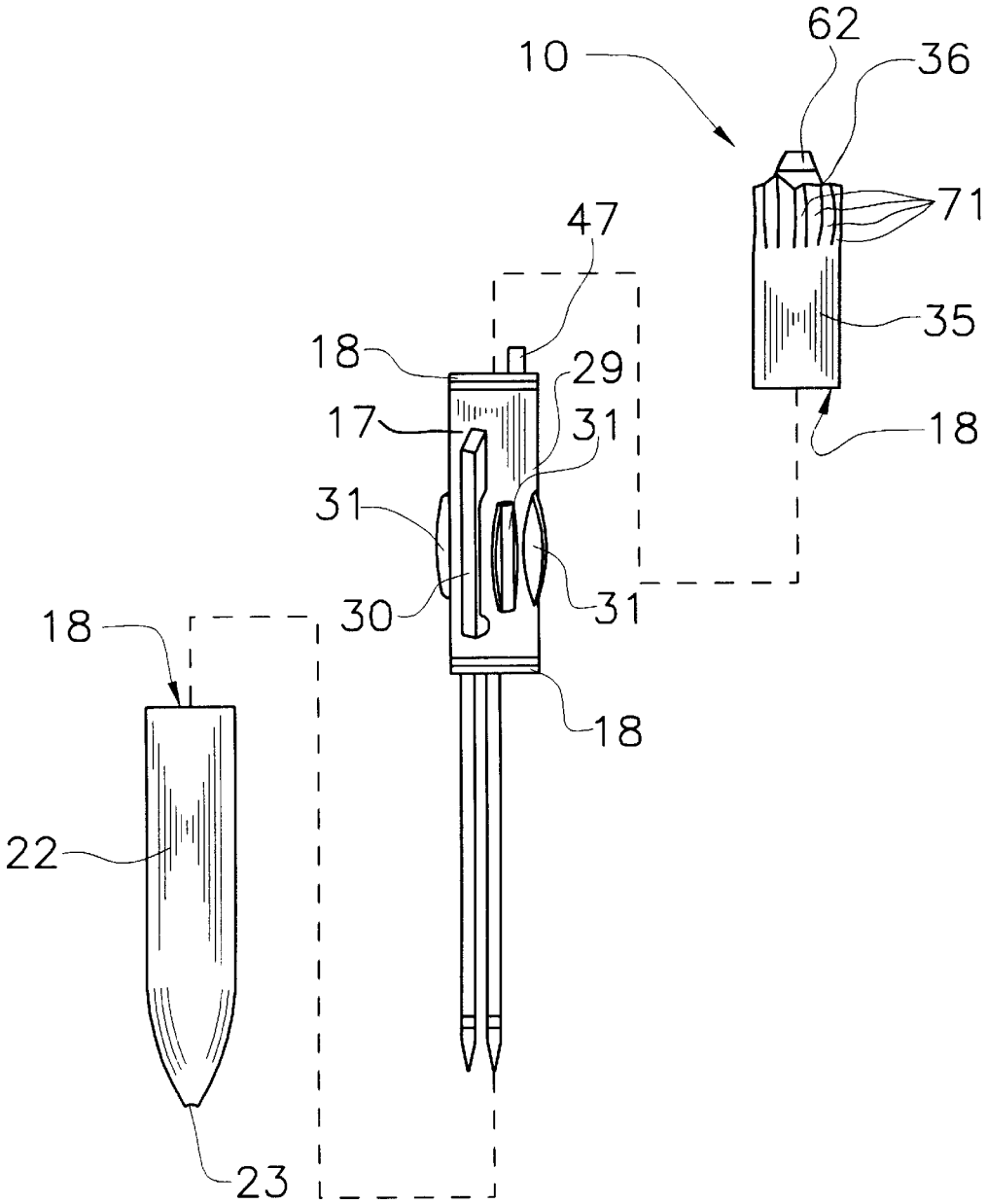
FIG. 2 is an exploded view of the three sections of the present invention.
Figure 3:
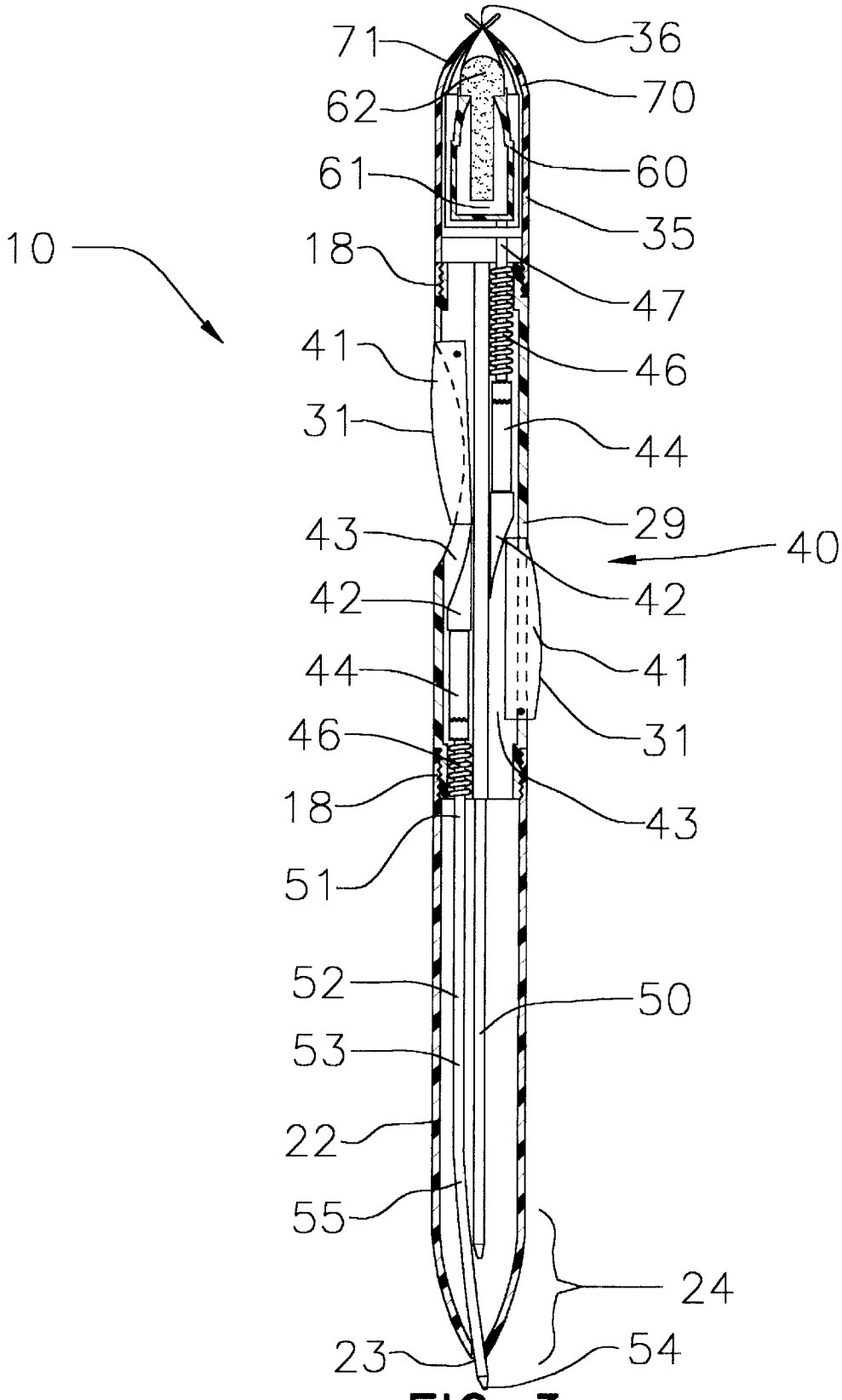
FIG. 3 is a cross sectional view of the present invention with one of the ink cartridges protracted in the position of use.
Figure 4:
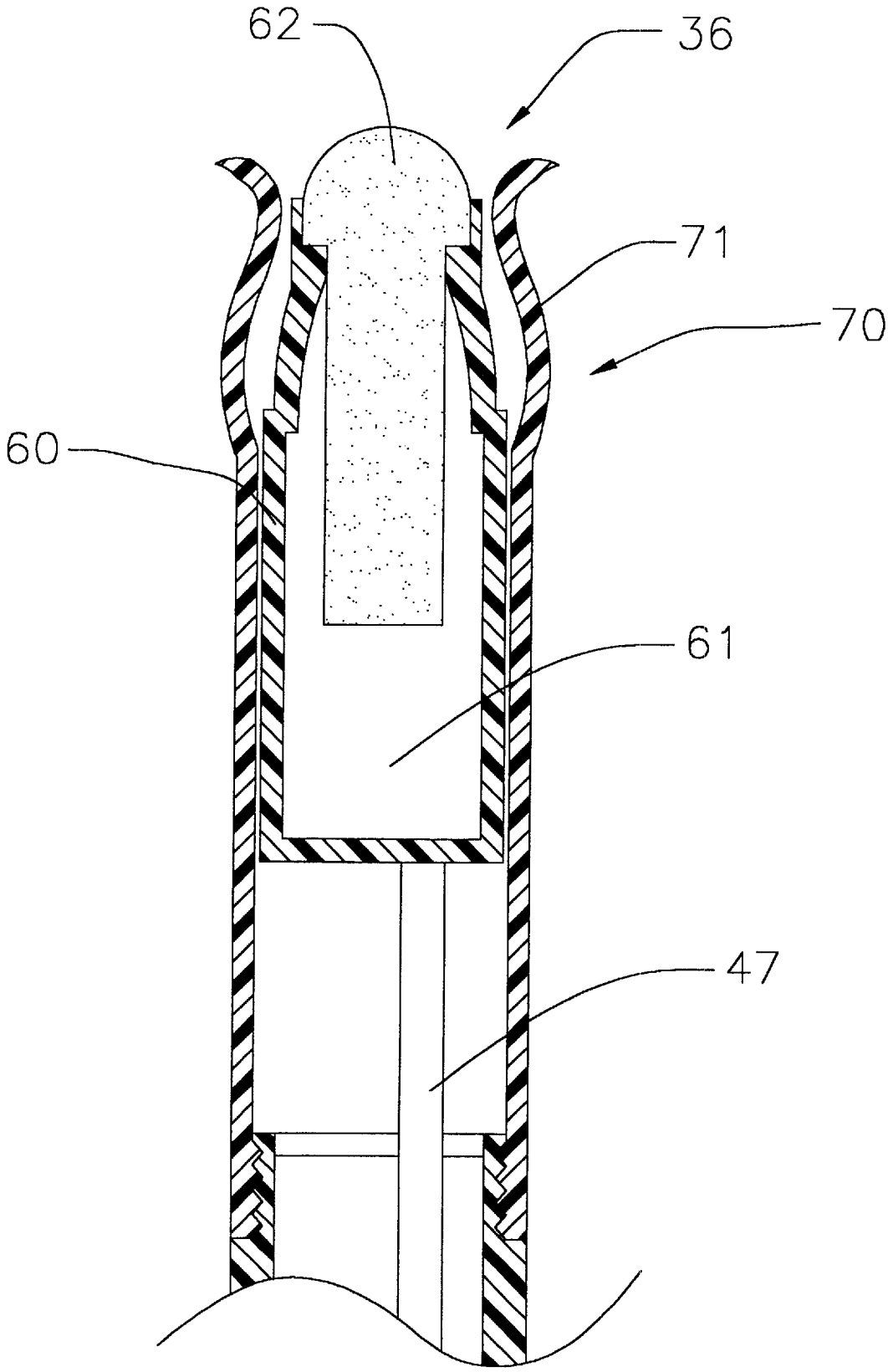
FIG. 4 is a cross sectional view of the rear barrel of the present invention with iris port in the open position and the correction fluid applicator protracted.

With reference now to the drawings, and in particular to FIGS. 1 through 4 thereof, a new writing instrument with retractable ink cartridges and retractable correcting fluid cartridge embodying the principles and concepts of the present invention and generally designated by the reference numeral 10 will be described.

As best illustrated in FIGS. 1 through 4, the writing instrument with retractable ink cartridges and retractable correcting fluid cartridge 10 generally comprises a main body or barrel 17 which may be constructed from a relatively rigid material such as plastic, metal, wood, ceramic or composite materials. To assist with maintenance such as the replacement of expendable elements of the writing instrument 10, the barrel 17 may be composed of two or more barrel sections. The various barrel sections may be connected by means of a barrel coupler 18. The barrel couplers 18 depicted in the illustrations comprises mated sets of threaded screw sections but the invention is not so limited. For example, the barrel couplers 18 may comprise a bayonet mount as is known, for example, in the mounting of camera lenses. Alternately the barrel coupler may comprise a tension ring latch as is practiced, for example, in childproof bottle caps. Numerous other alternatives are well known to those of skill in the art and it is anticipated that any may be employed without departing from the scope of the invention.

In the preferred embodiment the barrel 17 may be divided into three sections including a front barrel 22 which may be defined by the section that contains ink cartridges 50, a middle barrel that may be defined as the section that includes the actuators and/or the retraction/protraction mechanism 40, and a rear barrel 35 that may be defined as the section containing the correction fluid cartridge 60.

The front barrel 22 may comprise one or more ink applicator orifices 23 through which the applicator tip 54 of one or more ink cartridges 50 may protrude when in a position for use. In the illustrations the preferred embodiment is depicted with only one ink applicator orifice 23 through which any of the inherent ink cartridges 50 may protrude, but the invention is not so limited. For example, individual holes of differing sizes may be required to host different types of ink cartridges 50 or the design may require the use of two or more ink cartridges 50 simultaneously, which may necessitate the inclusion of multiple ink applicator orifices 23. The front barrel may also incorporate a funnel 24 section that may direct the ink cartridges 50 into the ink applicator orifice 23. The exterior of the front barrel may include a grip 25, as that is the location where a user may grip the writing instrument 10. The grip may comprise any one of the various types of writing instrument grips known and practiced in the art. For example, an irregular, patterned, or textured surface may be incorporated into the front barrel 22, or a rubberized sleeve that would fit over the front barrel or portions thereof may be employed, or adhesive rubberized gripping pads may be affixed to or incorporated into the front barrel 22.

The section of the middle barrel 29 may accommodate the protraction/retraction mechanism 40 discussed in greater detail below. The exterior of the middle barrel 29 may also include the actuators 31 that control the function of the protraction/retraction mechanism 40 or other functions of the writing instrument 10. The actuators 31 may take a variety of forms. In one preferred embodiment depicted in the illustrations, the actuators are elongated mechanical buttons, but the invention is not so limited. For example, the actuators may take the form of a slider control similar to the a box cutting utility knife, a twist ring as is practiced in lipstick or lip balm applicators, a telescoping compression section as is akin to other writing instruments, or an electric contact switch as is known in automatic antenna controls or television remotes. Numerous other control actuation devices are known to those of skill in the art and it is anticipated that any may be employed without departing from the scope of the invention. The exterior of the middle barrel may also include a fastening clip 30. The fastening clip 30 is a very familiar element of many writing instruments and is used to secure the writing instrument 10 to the top of a user's pocket, clip board, folder, papers, etc. The fastening clip may optionally be attached to other barrel sections depending on the specific design desired.

The rear barrel 35 may comprise one or more fluid applicator orifices 36 where the fluid applicator 62 of one or more correction fluid cartridges 60 may protract or project through in the position of use. In the illustrations, one preferred embodiment is depicted with only one fluid applicator orifice 36 through which any of the inherent correction fluid cartridges 60 may protract, but the invention is not so limited. For example, individual holes may be required for different colors or types of correcting fluids, or distinct orifices of differing sizes may be required to host different shapes of correction fluid applicators 62 such as narrow covering one line of text or wide covering two lines of text.

It may be desirable that the fluid applicator orifice 36 have the ability to open and close. Illustratively, the orifice may be open only when the correction fluid applicator 62 is in the position of use, and may otherwise remain closed and/or sealed when the fluid applicator 62 is in the position of storage. This function would help to preserve the life of the correcting fluid and keep the fluid applicator 62 relatively free from dried or caked-on fluid. The preferred embodiment as depicted in the illustrations includes an iris port 70 which may comprise a series of interlocking sealing plates 71 which can slide against each other, front to back, in a twisting or reciprocating circular pattern. The apparatus and method of iris valves, iris diaphragms, or twist apertures may be used to seal the fluid applicator orifice 36 when the fluid applicator is in the stored position. When the protraction/retraction mechanism 40 protracts the fluid applicator 62, the pressure of the fluid applicator 62 against the sealing plates 71 would untwist the sealing plates 71 from each other and open the iris port 70 to allow the fluid applicator 62 to protrude. Conversely, when the protraction/retraction mechanism 40 retracts the fluid applicator 62 the lack of force bearing against the sealing plates would allow the spring bias of the sealing plates 71 to twist themselves back into a closed and sealed arrangement. The illustrations depict the present invention incorporating an iris port 70, although the invention is not so limited. Alternatives to the iris port 70 may include a sphincter valve using an elastic conical aperture that stretches open upon protraction of the fluid applicator, or a mechanically activated door or hatch as is known in tooth paste dispensers and the like.

The rear barrel 35 may also incorporate a grip 25 similar to the section of the front barrel 22 as the writing instrument would be held by the rear end 35 when using the correction fluid applicator 62.

The apparatus that enables the functions of the writing instrument 10 may be contained within the interior of the barrel 17. Within the front barrel 22 there may be one or more ink cartridges 50. The variety of ink cartridges 50 may include cartridges with a variety of colors of inks (such as black, red and green ink), a variety of sizes of applicator tips 54 (such as fine point, medium point and wide point ball point tips), or a variety of applicator tip types (such as ball point, micro ball, felt tip, porous tip, fountain pen nibs). An ink cartridge 50 may comprise an elongated tube 52 with an applicator tip 54 at one end. Located at the opposite end of the tube 52 may be a rear end 51 that would engage with the protraction/retraction mechanism 40. The interior of the tube 52 may comprise an ink reservoir 53 containing ink 12. Since the tube 52 of the ink cartridge 50 may be required to bend so that the applicator tip 54 can be directed out an ink applicator orifice 23, the tube may incorporate a flexible section 55. The flexible section 55 of the tube 52 may include only a small portion of the tube 52 or may comprise the entirety of the tube extending from the applicator tip 54 to the rear end 51. Within the rear barrel 35 there may be one or more correction fluid cartridges 60. The variety of correction fluid cartridges 60 may include cartridges with a variety of colors of correction fluids (such as white, buff and amber colored fluids), a variety of sizes or shapes of fluid applicator 62 (such as fine point, calligraphic line or rounded ball tips), or a variety of applicator tip types (such as ball applicator, sponge applicator, brush applicator). A correction fluid cartridge 60 may comprise a fluid applicator 62 at one end and a fluid reservoir at the other end. The fluid applicator 62 is depicted in the drawings as a porous fluid conductive material such as a sponge or felt that would allow correction fluid 13 to accumulate in the pores of the material but not allow the fluid to flow from the material without being in contact with a dry substance such as a writing surface 11. The invention is not limited to porous type applicators as depicted in the illustrations. For example, alternatives to a sponge or felt tip fluid applicator 62 may include a roll-on ball application device as is used in ink pad refill fluids or personal deodorant bottles, or a brush applicator as is practiced in paint pens or liquid shoe polish applicators. The correction fluid cartridge 60 may also include a fluid reservoir 61 that would be in fluid communication with the fluid applicator 62.

An exterior of the body may be relatively cylindrical. The ink cartridge may be replaceably mounted in the body, and the correcting fluid cartridge may be replaceably mounted in the body. Further, the correcting fluid cartridge may be refillable.

The protraction/retraction mechanism 40 may be contained within the section of the middle barrel 29. The following is presented as an example, of one embodiment among a multitude of analogous mechanisms that could be employed to protract/retract the various ink 50 and/or correction fluid cartridges 60 from the writing instrument.

In the illustrated example, the actuator 31 is depicted as a button lever 41 comprising an elongated member hinged on one end. When the outer surface of the button is depressed the first end of the button will remain fixed at the axis point and the second end will travel in an arc. The second end of the button lever 41 is in contact with a slide block 42. The first end of the slide block 42 that is in contact with the second end of the button lever 41 is shaped in a wedge so that the arcing motion of the button lever 41 is translated into a linear sliding motion of the block within the slide block's 42 channel 43. The slide block channel 43 is incorporated into the interior body of the middle barrel 29 and a multitude of channels 43 may exist for other slide blocks 42. The second end of the slide block 42 is in contact with the first end of the linear ratchet assembly 44. The linear ratchet assembly 44 is well known and commonly used in retractable ballpoint pens. The linear ratchet assembly 44 is comprised of two nested cylinders with toothed rings designed to alternately engage advanced and rearward hold points incorporated within the channel. The rearward hold points are where the linear ratchet assembly 44 would be held in the position of storage. The advanced points are where the linear ratchet assembly 44 would be held in the position of use when the cartridge 50 and/or cartridge 60 would be used. The second end of the linear ratchet assembly 44 would be in contact or attached to the rear end 51 of the ink cartridge 50 or alternately to one end of a push rod 46 that would be in contact or attached to the correction fluid cartridge 60. To enable the action of the linear ratchet assembly 44 a spring may be connected to either the second end of the linear ratchet assembly 44 or to the ink 50 or fluid 60 cartridges. The spring would provide the bias necessary to enable the engage/disengage action required to move the cylinder from the advanced hold points to the rearward hold points thus protracting and retracting the cartridge 50 and/or cartridge 60.

In use, the user of the writing instrument 10 may depress the actuator 31 associated with the ink cartridge 50 to suit the user's needs. The applicator tip 54 of the associated ink cartridge 50 is then protracted from an ink applicator orifice located on the front of the pen. The writing instrument may include a variety of colors, sizes or types of ink applicator tips 54 from which to choose. The user then writes with the writing instrument 10 in the same manner practiced by other writing devices. When the user is finished using that particular ink cartridge 50, a second depression of the same actuator would retract the applicator tip 54 of the ink cartridge 50 into the barrel of the writing instrument.

If an error is found by the user, the same process for employing the ink applicator tip 54 can be practiced by the fluid applicator 62 of the correction fluid cartridge 60 by holding the writing instrument by the rear barrel 35 section as opposed to the front barrel 22 section when writing.

It would be possible to have one or more writing applicator tips and correcting fluid applicators protracted simultaneously if the user so desired as in the case of editing documents. The invention may also include an actuator 31 that would retract all applicators 54 and/or 62 with a single actuation so that a user would not have to retract all applicators individually.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A writing instrument comprising:

an elongated body having a first and second end;

an ink cartridge contained in the body, the cartridge comprising:
a reservoir of ink;
a ink applicator;

a correcting fluid cartridge contained in the body, the cartridge comprising:
a reservoir;
a correction fluid applicator;

a first mechanism for protracting/retracting a portion of the ink cartridge from an orifice on the first end of the body;

a second mechanism for protracting/retracting a portion of the correcting fluid cartridge from an orifice on the second end of the body;

a first actuator for controlling the first mechanism for protracting/retracting the applicator of the ink cartridge; and a second actuator for controlling the second mechanism for protracting/retracting the applicator of the correction fluid cartridge;

wherein each of the first and second mechanisms is independently actuatable by the actuators such that each of said cartridges is protractable and retractable regardless of a protracted or retracted position of another of the cartridges;

wherein a plurality of ink cartridges are mounted in said body, and the plurality of ink cartridges hold a variety of ink colors.

2. The writing instrument of claim 1 wherein an exterior of the body is relatively cylindrical.

3. The writing instrument of claim 1 wherein the body comprises two or more interconnecting pieces.

4. The writing instrument of claim 1 wherein the ink cartridge is replaceable in the body.

5. The writing instrument of claim 1 wherein the ink cartridge is flexible.

6. The writing instrument of claim 1 wherein the correcting fluid cartridge is replaceably mounted in the body.

7. The writing instrument of claim 1 wherein the correcting fluid cartridge is refillable.

8. The writing instrument of claim 1 wherein an exterior of the body includes a gripping surface.

9. The writing instrument of claim 1 wherein the body includes a fastening clip.

10. The writing instrument of claim 1 additionally comprising an apparatus for opening and closing the orifice on the second end of the body.

11. The writing instrument of claim 10 wherein the apparatus for opening and closing the orifice is substantially sealed in a closed position of the apparatus.

12. The writing instrument of claim 11 wherein the apparatus for opening and closing the orifice comprises an iris diaphragm.

13. A writing instrument comprising:

a generally cylindrical elongated rigid body having a first and second end, the body including three interconnecting barrel sections;

two replaceable ink cartridges contained in the first barrel section, each of the ink cartridges comprising:
a reservoir of ink;
a flexible portion;
an applicator located on one end;

a replaceable correcting fluid cartridge contained in the third barrel section, the correcting fluid cartridge comprising:
a reservoir;
an applicator located on one end;

a first mechanism contained in the second barrel section for protracting/retracting a portion of the applicator of one of the ink cartridges from a single open orifice in the first barrel section located at the first end of the body;

a second mechanism contained in the second barrel section for protracting/retracting a portion of the applicator of the correcting fluid cartridge from a resealable orifice in the third barrel section located at the second end of the body;

a first actuator for controlling the first mechanism for protracting/retracting the applicator of the one ink cartridge;

a second actuator for controlling the second mechanism for protracting/retracting the applicator of the correction fluid cartridge;

wherein each of the first and second mechanisms is independently actuatable by the actuators such that each of said cartridges is protractable and retractable regardless of a protracted or retracted position of another of the cartridges;

wherein the resealable orifice comprises an iris structure formed at the orifice on the second end of the body, the iris structure opening the orifice when the correction fluid cartridge is protracted by the second mechanism and closing the orifice when the correction fluid cartridge is retracted by the second mechanism; and wherein the iris structure comprises a plurality of sealing plates converging at the orifice, the sealing plates being flexible to permit outward flexing of the sealing plates when the correction fluid cartridge presses against and passes between the sealing plates during protracting of the correction fluid cartridge and to permit inward return of the sealing plates upon retracting of the correction fluid cartridge.

14. A writing instrument comprising:

an elongated body having a first and second end;

an ink cartridge contained in the body, the cartridge comprising a reservoir of ink and an ink applicator;

a correcting fluid cartridge contained in the body, the cartridge comprising a reservoir and a correction fluid applicator;

a first mechanism for protracting/retracting a portion of the ink cartridge from an orifice on the first end of the body;

a first actuator for controlling the first mechanism for protracting/retracting the applicator of the ink cartridge;

a second mechanism for protracting/retracting a portion of the correcting fluid cartridge from an orifice on the second end of the body;

a second actuator for controlling the second mechanism for protracting/retracting the applicator of the correction fluid cartridge;

an iris structure formed at the orifice on the second end of the body, the iris structure opening the orifice when the correction fluid cartridge is protracted by the second mechanism and closing the orifice when the correction fluid cartridge is retracted by the second mechanism;

wherein the iris structure comprises a plurality of sealing plates converging at the orifice, the sealing plates being flexible to permit outward flexing of the sealing plates when the correction fluid cartridge presses against and passes between the sealing plates during protracting of the correction fluid cartridge and to permit inward return of the sealing plates upon retracting of the correction fluid cartridge.

* * * * *